United States Patent [19]

Woods

[11] Patent Number: 4,901,422

[45] Date of Patent: Feb. 20, 1990

[54] BADGES AND A METHOD FOR THEIR MANUFACTURE

[76] Inventor: William J. Woods, 56, Glenarriff Road, Dublin 7, Ireland

[21] Appl. No.: 165,461

[22] Filed: Mar. 11, 1988

[30] Foreign Application Priority Data

Mar. 12, 1987 [IE] Ireland ..... 642/87

[51] Int. Cl.[4] ..... B21C 23/00

[52] U.S. Cl. ..... 29/527.6; 40/1.5; 72/254

[58] Field of Search ..... 29/527.6; 72/254; 40/1.5, 1.6, 616

[56] References Cited

U.S. PATENT DOCUMENTS

| | | | |
|---|---|---|---|
| 2,242,967 | 5/1941 | Carlile . | |
| 2,795,064 | 6/1957 | Leonard, Jr. . | |
| 3,082,595 | 3/1963 | Dodinat | 59/35.1 |
| 3,193,956 | 7/1965 | Przybysiski | 40/1.5 |

FOREIGN PATENT DOCUMENTS

| | | | |
|---|---|---|---|
| 19633 | of 1895 | United Kingdom | 40/1.5 |
| 284484 | 2/1928 | United Kingdom . | |
| 370595 | 4/1932 | United Kingdom . | |
| 632696 | 11/1949 | United Kingdom . | |
| 2160493 | 12/1985 | United Kingdom | 40/1.5 |

*Primary Examiner*—Howard N. Goldberg
*Assistant Examiner*—Irene Cuda
*Attorney, Agent, or Firm*—Young & Thompson

[57] ABSTRACT

The invention is concerned with a method of manufacturing badges and insignia, for example of the type worn by policemen and army personnel. The method comprises extruding metal, preferably aluminum, to form a channel-shaped section. The section has a flat planar surface portion and a pair of spaced parallel flanges projecting rearwardly from the rear face of the surface portion and at right angles to the face. The extruded section is passed through a punching machining machine, and side-acting punches remove portions of the metal forming the flanges to form lugs. A badge is formed in the planar surface portion of the section, and the completed badge is severed from the remainder of the extrusion. The invention also includes a badge made by the method which includes fastening lugs projecting from the reverse of the badge and formed integrally with the badge by extrusion.

9 Claims, 5 Drawing Sheets

BADGES AND A METHOD FOR THEIR MANUFACTURE

BACKGROUND OF THE INVENTION

1. Field of the Invention

The invention relates to badges and to a method for their manufacture. The invention is particularly concerned with badges, insignia, buttons, and the like of the type used on uniforms and uniform caps, for example those worn by policemen and army personnel (and which hereinafter collectively referred to as "badges").

2. Description of the Prior Art

Such badges are commonly provided with a pair of lugs (usually referred to as "button backs") which extend rearwardly from the badge and at right angles to the plane of the badge. The lugs are intended to be inserted through perforations made in the material of the uniform or cap such that the badge can be held in position on a uniform or cap by inserting a pin through apertures in the lugs. Traditionally such badges were pressed from copper or brass or a mixture of these metals and the lugs were subsequently welded or soldered to the rear of the badge. More recently, it has been the practice to manufacture such badges from aluminum, and the lugs are fused to the rear of the badge by fusion welding. However, this has not been satisfactory in practice and there has been a high incidence of failure of the fusion weld with the result that the lugs frequently are broken away from the badge.

It has been known to produce badges, brooches and the like having lug portions which are formed without welding or soldering. For example, British Patent Specification No. 284,484 describes a bar brooch which is formed from a metal blank which has at one end two oppositely projecting ears and the blank is folded and bent to bring the ears into a vertical plane. British Patent Specification No. 370,595 discloses an attachment or suspension device for brooches, medals, badges or the like, in which lugs are formed in a similar manner from a sheet metal blank by bending. However, lugs formed by bending sheet metal tend to lack sufficient rigidity and require the use of flexible sheet metal. It is known from British Patent Specification No. 632,696 to manufacture a mounted button or cap badge by forming by means of a die stamping operation a mount or badge and simultaneously forming on the rear face of the mount or badge small projections for use in attaching the badge to a button cup.

BRIEF SUMMARY OF THE INVENTION

It is an object of the invention to overcome the aforesaid disadvantages of known badges and to provide a metal badge having fastening lugs which cannot easily be displaced.

According to a first aspect, the invention provides a method for manufacturing metal badges and the like of the kind having a lug or lugs projecting at right angles from the surface of the badge which comprises extruding a metal section comprising a flat planar surface with at least one flange extending at right angles thereto, removing a portion of the material of the flange to form a fastening lug, and forming a badge from the planar surface of the extrusion, such that the lug is formed as an integral part of the badge. Preferably, the extruded metal section is a substantially channel-shaped section having a pair of parallel spaced flanges extending at right angles from the planar surface of the section, and the lugs are cut from said flanges.

In another aspect the invention provides a metal badge having at least one lug extending at right angles from the plane of the badge, the lug being formed as an integral part of the badge. Preferably a pair of spaced lugs is provided on each badge.

The metal used in the formation of the badge may be selected from copper, brass, bronze and aluminum, but preferably is aluminum.

BRIEF DESCRIPTION OF THE DRAWINGS

The invention is further illustrated with reference to the accompanying drawings, wherein.

DETAILED DESCRIPTION OF THE DRAWINGS

Figure 1:
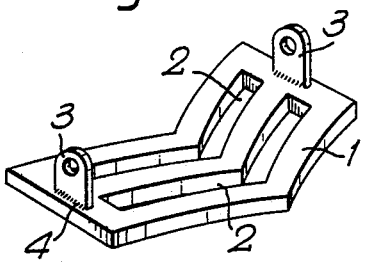
FIG. 1 is a rear perspective view of a conventional chevron-type badge made from aluminum.

Referring to FIG. 1 of the drawings this illustrates a conventional chevron-type badge made from aluminum. The badge comprises a flat planar portion 1 from which two substantially V-shaped apertures have been punched to form the chevron. Lugs 3 are attached to the flat planar portion 1 by means of fusion welds 4. It has been found in practice that such welds have a tendency to fracture such that the lugs 3 are broken off in use.

Figure 2:
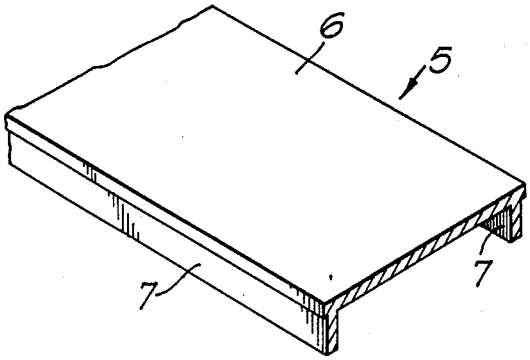
FIG. 2 is a perspective view of one embodiment of a metal section for use in manufacturing badges according to the invention.
Figure 3:
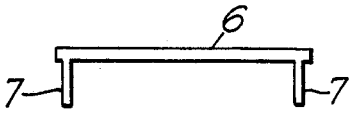
FIG. 3 is an end elevation of the extrusion of FIG. 2.

A method of manufacturing a chevron-type badge of the type illustrated in FIG. 1 but with the lugs 3 formed integrally with the remainder of the badge, is illustrated in FIGS. 2 to 6. According to the invention, a channel-shaped extrusion 5 is extruded from a suitable metal, in well known manner. The extrusion 5 comprises a flat planar strip 6, of indefinite length. A pair of longitudinal flanges 7 extend at right angles from the strip 6. The flanges 7 are disposed parallel to each other in spaced relation and are inset slightly from the edge of the strip 6 as shown in FIG. 3. The positioning of the flanges corresponds to the positioning of the lugs 3, as hereinafter described.

Figure 13:
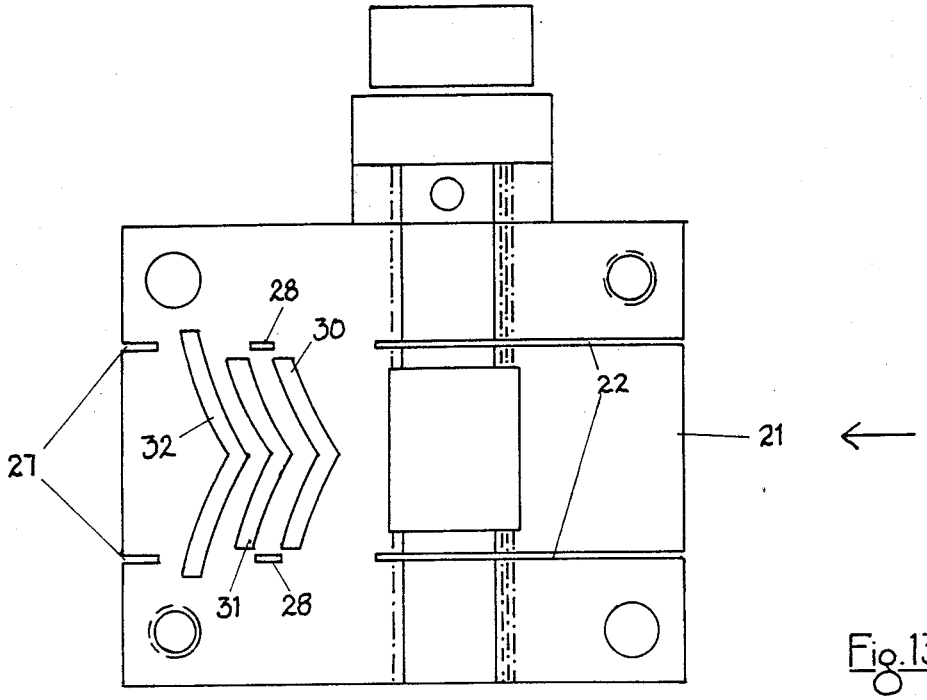
FIG. 13 is a plane view of the tool of FIG. 12.
Figure 12:
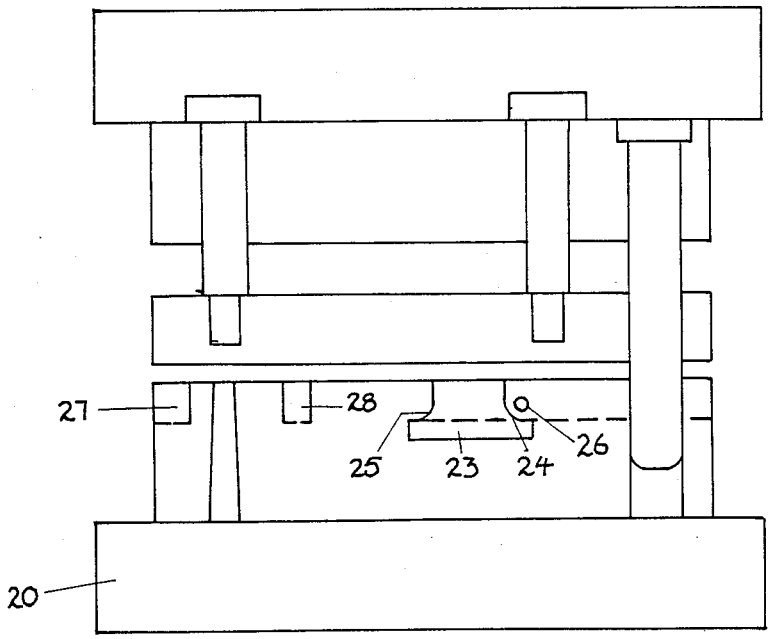
FIG. 12 is a side elevation of a tool for use in the formation of a badge of the invention.
Figure 14:
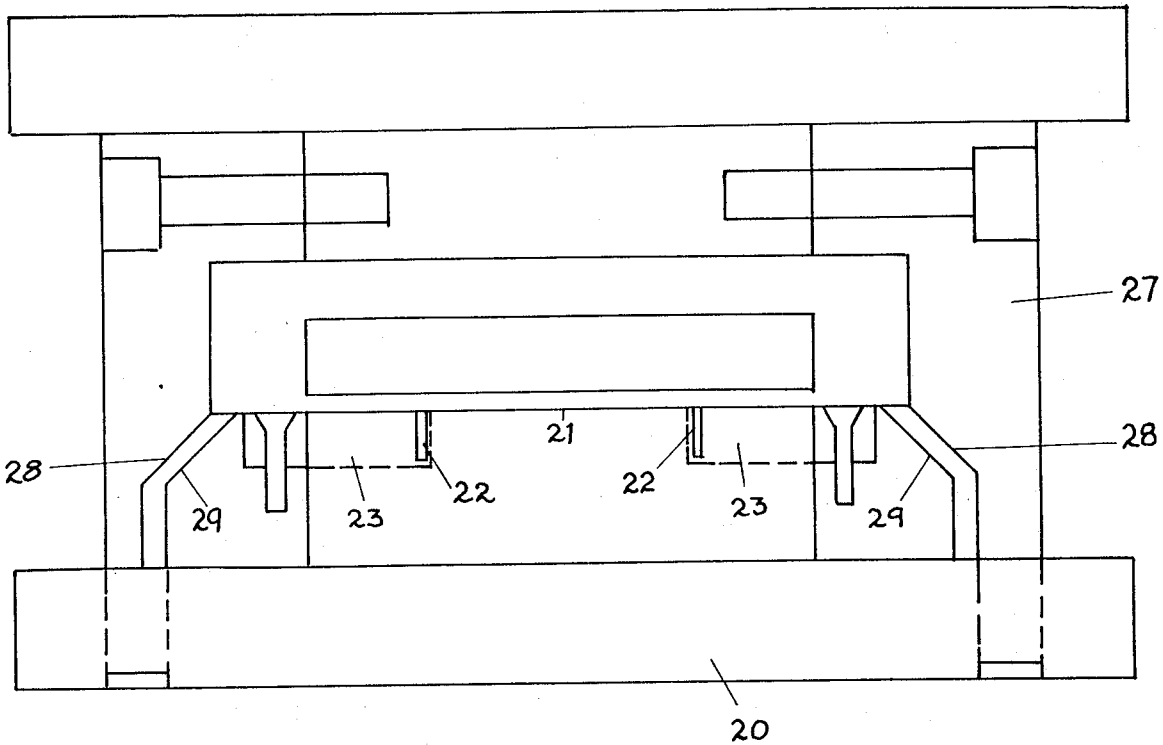
FIG. 14 is an end elevation of the tool of FIG. 12.

The extrusion 5 is passed through a punching machine. A suitable punching tool is illustrated in FIGS. 12 to 14.

The punching tool comprises a base 20 which supports a work platform 21. The work platform is formed with a pair of spaced parallel grooves 22 (see FIG. 13). The grooves 22 are spaced apart a distance equal to the spacing of the flanges 7 of the extrusion 5. The extrusion 5 is passed into the punching machine in the direction of the arrow shown in FIG. 13. The flanges 7 are inserted in the grooves 22. A pair of side-action punches 23 move inwardly, transversely to the direction of travel of the extrusion 5. The punches are shown in more detail in FIGS. 12 and 14 and are illustrated in the closed position. Each punch 23 is a composite punch having cutting edges 24, 25 on opposite sides thereof. Associated therewith is a circular punch 26. The punches 23, 26 are caused to move inwardly by means of a downwardly descending cam member 27. The cam members 27 are formed with inclined faces 28 which contact cam followers 29 on the punches, forcing them to move inwardly as the cam members descend. The cams are shown in the fully descended position in FIG. 14. The punches are moved into the open position by return springs (not shown) when the cam members 27 are raised.

Figure 4:
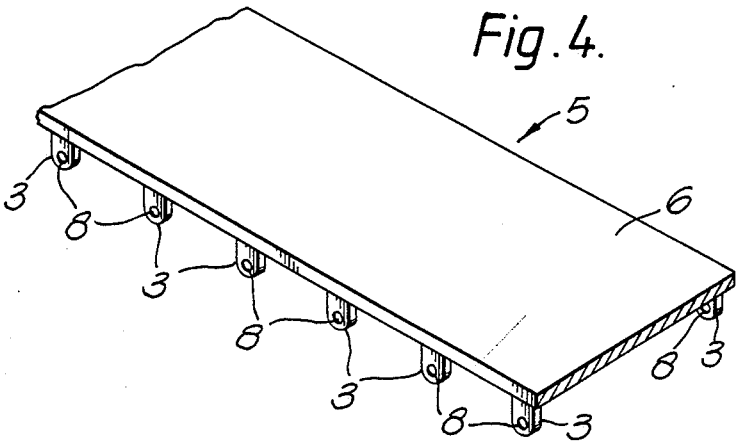
FIG. 4 is a perspective view showing the formation of lugs in the extrusion of FIG. 2.
Figure 5:
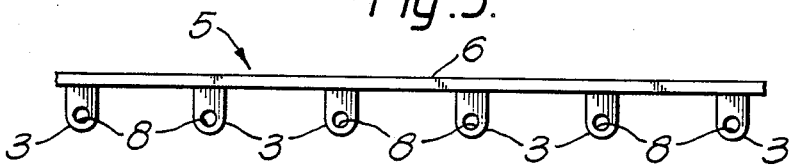
FIG. 5 is a side view of the extrusion of FIG. 4.

As the extrusion 5 is passed through the punching machine, cutting edges 24, 25 each cut out a part of the material of the flanges 7 to form the lugs 3 as shown in FIGS. 4 and 5. It will be appreciated that during one operation of the punching tool, punches 23 remove the material between each exceeding lug 3, so that each lug 3 is only partly formed during each inward operation of the punches 3. At the same time, the circular punch 26 forms the pin-holes 8 in the lugs. As the lugs 3 are cut the extrusion 5 is moved forwardly in the punching tool and a forward pair of lugs 3 is located in grooves 27 formed in the platform 21 while a rearwardly pair of lugs is located in grooves 28 formed in the platform 21. A vertically acting punch descends to cut out the substantially V-shaped apertures 2 to form the chevrons and to sever the badge 1 from the extrusion along the lines of cut shown in FIG. 6. The vertically acting punch has three blades 30, 31 and 32. The smaller blades 30 and 31 remove metal from the flat planar portion 1 to form the V-shape apertures 2, whereas the blade 32 cuts along the line of cut 9 to sever each formed badge from the extrusion.

Figure 6:
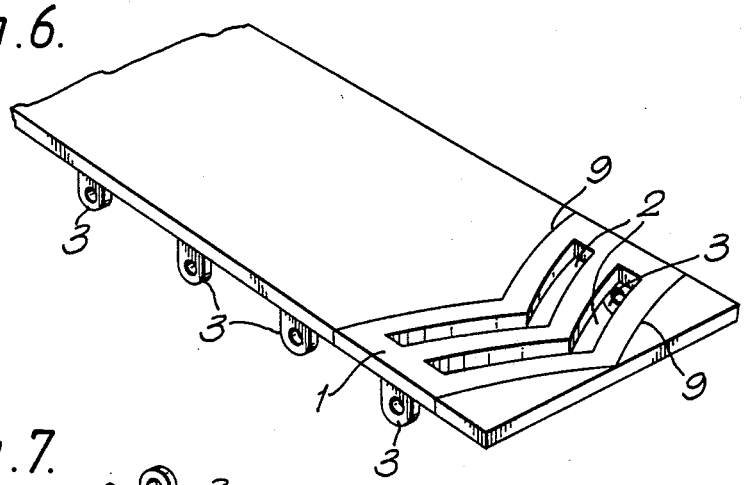
FIG. 6 is a perspective view of the extrusion of FIG. 2 showing a further stage in the manufacture of the badge.

For the sake of simplicity, only one formed badge 1 is shown in FIG. 6 although it will be appreciated that the lugs 3 and remainder of the badge 1 are formed simultaneously during the cutting operation.

Figure 7:
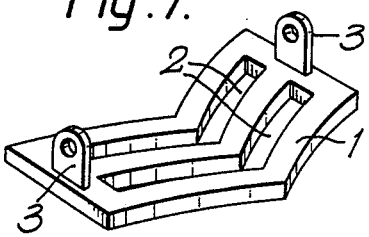
FIG. 7 is a rear perspective view of a chevron-type badge made according to the invention.

The completed chevron-shaped badge is shown in FIG. 7. By using the method of the invention, the lugs 3 are formed integrally with the remainder of the badge.

Figure 8:
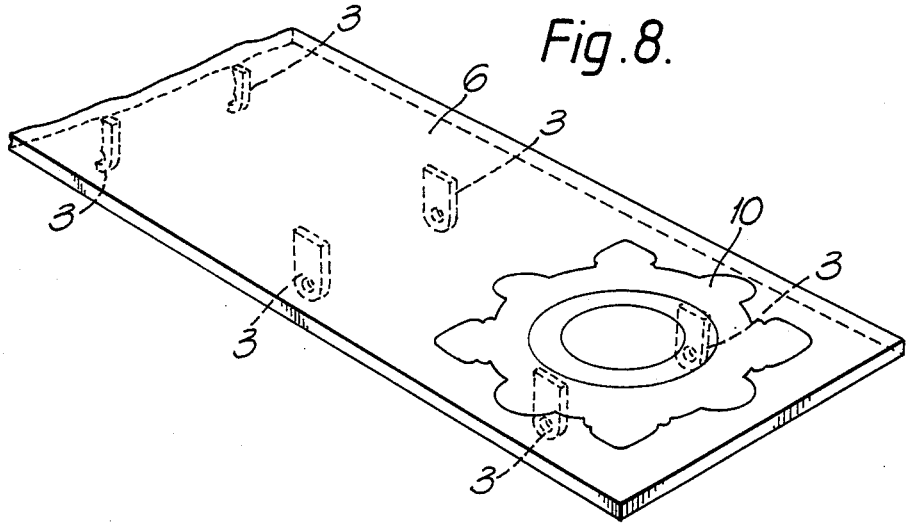
FIG. 8 is a perspective view illustrating the formation of a badge according to the invention by means of a coining operation.
Figure 9:
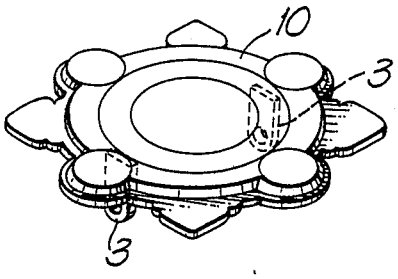
FIG. 9 is a perspective view from above of a badge made by the coining operation of FIG. 8.

In the embodiment shown in FIG. 8, a coined badge is obtained from the channel-shaped metal strip using a compound coining and blanking tool. In this arrangement, the lugs 3 are cut from the flanges 7 as described in relation to FIGS. 2 to 7. However, the badge itself is cold-formed using male and female dies of a compound coining and blanking tool. The tool first cuts the outline of the badge from the strip 6 then coins the shape 10 of the badge.

Figure 10:
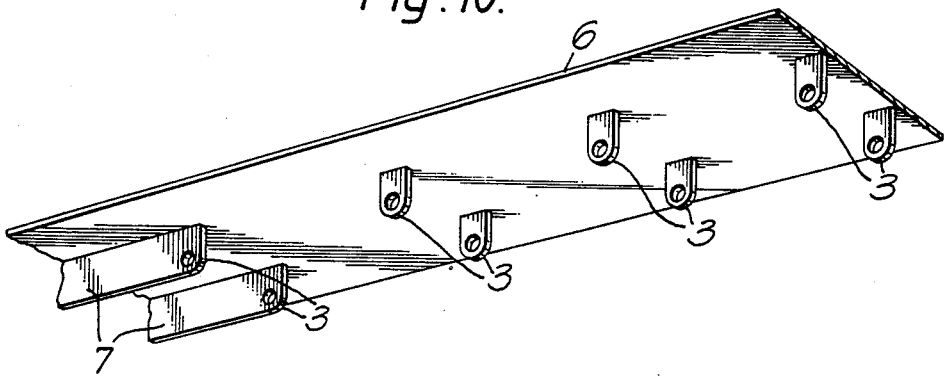
FIG. 10 is an underside perspective view of an extruded aluminum section shown partly cut in the formation of lugs.
Figure 11:
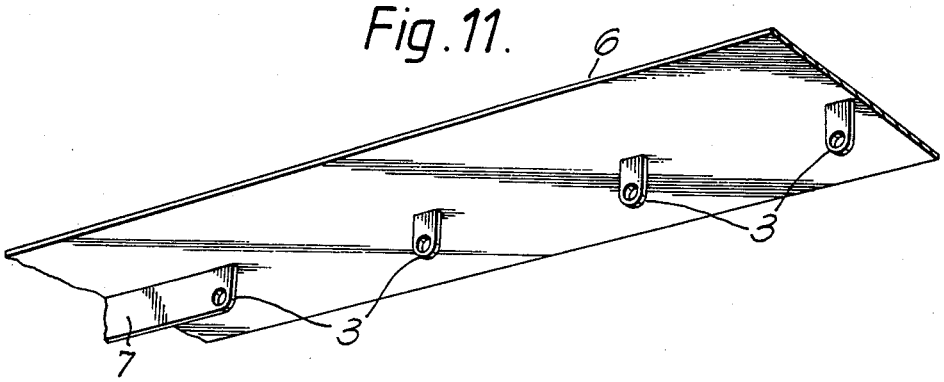
FIG. 11 is an underside perspective view of an extruded metal section having a single flange shown partly cut in the formation of lugs.

FIG. 10 shows a further embodiment of an extrusion in which the longitudinal flanges 7, and hence the opposed lugs 3 are located closer to each other than is the case with the extrusion of FIG. 2. For illustrative purposes the drawing shows the removal of part of the flange 7. An embodiment having a single flange 7 is illustrated in FIG. 11, and with this arrangement a single lug 3 is formed on each badge cut from the extrusion.

The metal used in the manufacture of badges according to the invention may include any metal capable of extrusion. For example, the metal may be selected from copper, brass, bronze and aluminum. Aluminum has been found to be particularly suitable because it is easy to extrude, is robust and rigid in use, and is economical in use.

The invention is not restricted to the particular shapes of the badges illustrated, and a wide variety of badges, including numeral-type badges, can be manufactured using the method of the invention. Because the lugs 3 are formed integrally of the remainder of the badge, the badge is a much stronger construction than conventional fusion-welded aluminum badges. The finished badges may be anodised as required to alter the color of the metal.

I claim:

1. A method of manufacturing a badge which comprises extruding metal to form an extrusion having a surface portion and at least one flange portion extending rearwardly therefrom, removing a portion of the metal of the flange portion to form a fastening lug integral with and projecting from the surface portion, and forming a badge in the surface portion.

2. A method as claimed in claim 1, in which the extrusion has a surface portion and a pair of parallel flanges extending rearwardly therefrom, and spaced apart on the rear of said surface portion.

3. A method as claimed in claim 1, in which the metal is aluminum.

4. A method of manufacturing a badge which comprises extruding metal to form a substantially channel-shaped section, said section comprising a planar surface portion having a front face and a rear face, and a pair of spaced parallel flanges projecting rearwardly from the rear face of the surface portion and at right angles thereto, removing a portion of the metal of the flanges to form lugs, forming a badge in the planar surface portion, and severing the badge which has a pair of lugs formed integrally therewith, from the remainder of the extrusion.

5. A method as claimed in claim 4, wherein holes are cut in the lugs.

6. A method as claimed in claim 4, wherein the lugs are cut from the flanges by means of opposed side-acting punches of a punching machine.

7. A method as claimed in claim 6, wherein the badge is formed and cut from the extruded section by vertically acting punches.

8. A method as claimed in claim 4, in which the metal is aluminum.

9. A method of manufacturing a badge which comprises taking a metal extrusion in the form of a channel-shaped section having a flat planar surface portion and parallel flanges projecting rearwardly from the flat planar surface portion and at right-angles thereto, feeding the extrusion through a punching machine which removes a portion of the metal of the flanges to form oppositely arranged lugs integral with and projecting from the flat surface portion, forming a badge in the flat planar surface portion of the extrusion and severing the badge with a pair of lugs formed integrally therewith from the remainder of the extrusion.

* * * * *